United States Patent [19]

Chambon et al.

[11] Patent Number: 4,470,707

[45] Date of Patent: Sep. 11, 1984

[54] ELECTRONIC SETTING FOR ANALOG TIMEPIECE

[75] Inventors: Jean P. Chambon, Montfaucon Saone; Paul Grand-Chavin, Besancon; Jean P. Migeon, Recologne; Georges J. Perrin, Thise; Michel G. Plancon, Besancon, all of France

[73] Assignee: Timex Corporation, Waterbury, Conn.

[21] Appl. No.: 467,538

[22] Filed: Feb. 17, 1983

[51] Int. Cl.[3] ..... G04B 23/02; G04B 19/04

[52] U.S. Cl. ..... 368/74; 368/80; 368/187

[58] Field of Search ..... 368/28, 72–74, 368/76, 80, 155–157, 228, 250, 251, 187

[56] References Cited

U.S. PATENT DOCUMENTS

| | | | |
|---|---|---|---|
| 4,205,519 | 6/1980 | Deruns | 368/73 |
| 4,223,523 | 9/1980 | Kamijo | 368/74 |
| 4,259,737 | 3/1981 | Berney | 368/66 |
| 4,266,288 | 5/1981 | Berney | 368/28 |
| 4,358,840 | 11/1982 | Ono et al. | 368/251 |
| 4,419,019 | 12/1983 | Nishimura et al. | 368/74 |
| 4,433,918 | 2/1984 | Nishimura et al. | 368/74 |

*Primary Examiner*—Vit W. Miska

*Attorney, Agent, or Firm*—William C. Crutcher; Joseph A. Biela

[57] ABSTRACT

An electronic analog timepiece is disclosed that utilizes digital storage devices for setting alarm time and when selectively displaying, in response to the activation of a setting member, either alarm time or actual, updated time by the timepiece hands. When setting the alarm time, the minute hand and second hand are positioned on the timepiece display to indicate alarm time in hours and minutes, respectively. Specifically, the minute and second representations of the minute hand and second hand positions on the display are transformed, in a selected storage device, to alarm time hour and minute representations, respectively. When displaying either alarm time or actual, updated time from the other time presently being displayed, the setting member is activated to produce fast rotation of the hands from one time setting to the other.

6 Claims, 13 Drawing Figures

ELECTRONIC SETTING FOR ANALOG TIMEPIECE

BACKGROUND OF THE INVENTION

This invention relates to an electronic analog timepiece and, in particular, to secondary timepiece functions produced in response to the predetermined settings or positions of the timepiece hands.

Timepieces that have analog displays include a crystal controlled oscillator and a stepping motor display driver. In order to provide for time correction, a correction control member such as a crown is positioned and rotated to produce movement of the hands of the timepiece in response to impulses provided by the stepping motor. U.S. Patents describing such electronic analog timepieces include U.S. Pat. No. 4,192,134 issued to Yoshida and U.S. Pat. No. 4,112,671 issued to Kato et al.

It is also known to use a single pushbutton switch for controlling various time setting modes for timepieces as illustrated in U.S. Pat. No. 3,953,964 issued to Suppa et al. and now recently allowed as a divisional reissue patent U.S. Pat. No. Re. 31,225. U.S. Pat. No. 4,192,134 issued to Yoshida shows a single pushbutton that achieves alternating forward and backward hand movement for time correction. A problem associated with analog stepping motor timepieces is that the timekeeping is disturbed if, for example, time zone changes are made during which the hour hand is repositioned. U.S. Pat. No. 4,357,693 issued to Plancon et al. shows a timepiece having a single manual pushbutton switch and providing proper compensation for the time used in making time correction in either direction.

Generally, timekeeping signals actuate drive circuits to provide drive pulses of selected wave shapes to drive a stepping motor which turns hour, minute and sometimes second hands. Timepieces which utilize stepping motors include U.S. Pat. No. 3,818,690 issued to Schwarzschild and U.S. Pat. No. 4,070,279 issued to Oudet et al.

Movement of the timepiece hands can occur at rapid rates in both the forward and reverse directions as disclosed in U.S. Pat. No. 4,173,863 issued to Motoki and U.S. Pat. No. 4,030,283 issued to Sauthier. Rapid movement of timepiece hands is also shown in U.S. Pat. No. 4,357,693 issued to Plancon et al. and having common assignee herewith.

Many alarm mechanisms have been used in prior art timepieces to set the alarm time. However, alarm setting mechanisms have not significantly improved in electronic quartz crystal timepieces. One attempt at improving alarm setting accuracy is disclosed in U.S. Pat. No. 4,223,523 issued to Kamijo. The electronic watch described in the patent includes an alarm which can be set by rotating the watch hands forward to the desired alarm time by slowly advancing the hands to the exact alarm setting. The timepiece then rapidly returns the hands to the actual present time. The watch of the Kamijo patent, however, sets the alarm time in the same manner in which it sets actual time and only by moving the hands in the forward or clockwise direction. In other words, an alarm time of 2 o'clock would be set by clockwise-positioning the minute hand in the direction of 12 o'clock and the hour hand in the direction of 2 o'clock. No provision appears to have been made for PM or AM alarm settings. Furthermore, to keep track of the alarm setting with respect to the actual time, counters have been implemented to count the number of drive pulses required to advance the hands to the alarm setting, to record the time elapsed in setting the alarm including the time required for advancement and return of the hands and to count the number of pulses required for hand return after the alarm time is set. These counters are required to compensate for the amount of time required to set the alarm time so that the alarm will be actuated at the proper moment.

U.S. Pat. No. 4,358,840 issued to Ono et al. discloses an electronic timepiece that detects electrically whether or not an alarm time is coincident with the present time without the use of mechanical means for detecting the location of the timepiece hands. A time difference counter is implemented for counting and storing the value corresponding to the difference in time between the alarm time and the present time. A display-time difference counter is implemented for calculating and storing the value corresponding to the difference in time between the display time and the present time. Another counter is implemented for receiving the content of the time difference counter when the content of the display-time difference counter is zero. As a result, the content of the other counter corresponds to the difference between the contents of the time difference counter and the display time difference counter. When the content of the other counter becomes zero, the alarm is activated. The timepiece operation requires relative (difference) relationships among alarm time, present time, and display time to be stored in memory locations and uses numerous counters, switches, and discriminators to control the drive of the time-indicating hands based on these stored differences.

What is needed is an electronic analog timepiece which provides simplified accurate electronic setting of the alarm time using timepiece hands of the analog display for setting the alarm.

Accordingly, an object of the invention is to provide for simplified electronic setting of alarm time using minute and second hands of the display to set the hour and minutes of the alarm time.

Another object of the invention is to provide for alarm time setting by rotating timepiece hands in either the clockwise or counterclockwise directions.

Another object of the invention is to set alarm time and display either alarm time or actual, updated real time without having to take into account the amount of time elapsed in either setting alarm time or when selectively displaying either alarm time or real time.

Yet a further object of the invention is to set the alarm time hour by rotating the timepiece minute hand over a span of minutes from the twelve o'clock position, and to obtain the same alarm time hour setting by moving the timepiece minute hand to any discrete position within a range of minutes having a low limit equal to a whole number multiple of five, i.e., 10, and a high limit equal to the same whole number multiple of five plus four, i.e. 14.

Another object of the invention is to provide fast rotation of the timepiece hands as they move from the display of one time setting to another, i.e. from alarm time setting to real or actual time setting.

Another object of the invention is to provide for actual time to be continuously updated without interruption regardless of the time setting operation being performed.

SUMMARY OF THE INVENTION

Disclosed is an electronic analog timepiece having the capability of providing at least one timepiece secondary function such as alarm time setting. The timepiece includes a motor control circuit for controlling the movement of the second, minute and hour hands, a manually controlled switch for displacing and positioning the timepiece hands for displaying either present time or a setting representative of the time of occurrence of the secondary function. The timepiece also includes three storage devices or three counters each storing hours, minutes and seconds representations. A first counter is used to maintain the real time. A second counter is used to store the secondary function, such as the alarm time in hours and minutes, which is set by positioning the minute and second hands. A third counter is used for storing a value representing the position of the timepiece hands whenever, for example, present time or a secondary function is displayed. The timepiece further includes a comparator for comparing the content of the second counter with the content of the first counter in order to actuate the timepiece alarm or secondary function when the content of the counters are substantially equal. The comparator is also used for comparing the content of the third counter with the content of the first counter to provide for actuation of the motor control circuit while the compared contents are unequal in order to displace and position, by the shortest route and at an accelerated rate, the timepiece hands. In this case, the hands are rotating from their representation of the secondary function time to the actual, updated time without changing or disturbing the real or actual time in the first counter. The comparator also compares the content of the third counter with the content of the second counter so that the display hands again rotate at an accelerated rate and over the shortest route from their representation of actual time to the representation of secondary function (alarm time) which is stored in the second counter. In this case, the content of the second counter is unchanged and the content of the first counter continues to be updated without interruption.

BRIEF DESCRIPTION OF THE DRAWINGS

FIG. 1*c* is a flow chart describing the operational sequence of the timepiece circuitry of FIG. 1*a.

DESCRIPTION OF THE PREFERRED EMBODIMENTS

This invention relates to an electronic analog timepiece and, in particular, to secondary timepiece functions produced in response to the predetermined settings or positions of the timepiece hands.

Figure 1A:
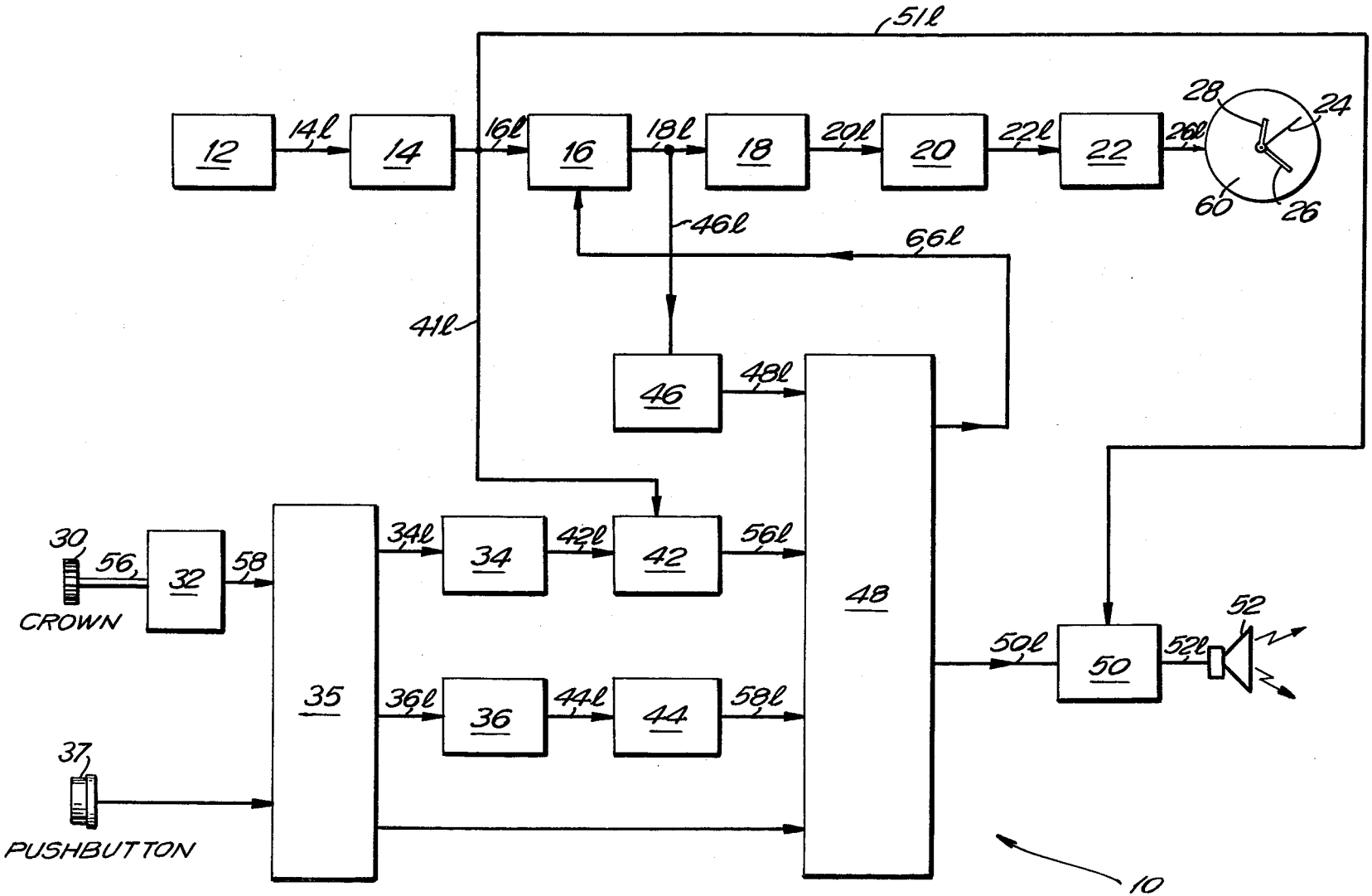
FIG. 1*a* is a functional block diagram of the circuitry of the timepiece of the invention.

FIG. 1*a* shows the components of electronic analog timepiece 10 including those that provide for the secondary functions of the timepiece such as the alarm. Substantially all of the components of the timepiece are conventional and known in the art. However, the components cooperate with each other, in the manner described below, to provide a novel timepiece that produces secondary timepiece functions, such as an alarm, in response to a novel method of setting the timepiece hands.

Electronic analog timepiece 10 includes high frequency oscillator circuit 12, frequency divider network 14, motor control circuit 16, driver circuit 18, motor 20, gear train 22, second hand 24, minute hand 26 and hour hand 28. Electronic analog timepiece 10 further includes components which provide for the setting and operation of secondary functions such as the alarm which will be described later. These components include external setting member 30 (external to the timepiece case), setting mechanism 32, time setting circuit 34, alarm setting circuit 36, control circuit 35, setting member 37, first or real time counters 42, second or alarm counters 44, third or hand movement counters 46, comparator 48, alarm driver 50 and alarm means 52.

Oscillator circuit 12 provides a high frequency output signal to frequency divider network 14 on line 141. The oscillator output frequency and the components of each stage of the divider network are predeterminedly selected so as to provide at least one output signal, of predetermined frequency, from the divider network. Specifically, divider network 14 provides a 1 Hz signal on line 161 to motor control circuit 16, to real time counters 42 via line 411 and to alarm driver 50 via line 511. The motor control circuit provides a 1 Hz signal, during normal timepiece timekeeping operation, to driver 18 along line 181. The driver controls the operation of motor 20 by providing control signals to the motor along line 201. The motor 20, when actuated by the control signals, drives gear train 22 by providing appropriate signals to it on line 221. The gear train produces rotational motion of second hand 24, minute hand 26 and hour hand 28 via line 261 in a manner known in the art.

Setting member 30, such as a crown as shown in FIG. 1*a*, external to timepiece casing 54, is provided for enabling the user to set a number of functions, such as alarm setting, which are more fully described below. The external setting member is connected to shaft 56 which, in turn, is connected to setting mechanism 32 which is actuated to provide signals to control circuit 35 via line 58. Control circuit 35, depending on the axial position and rotational movement of the crown and shaft, selectively provides signals to either time setting circuit 34 via line 341 or alarm setting circuit 36 via line 361 depending upon whether the timepiece hands are to be positioned to display the proper time or the desired alarm setting, respectively.

Figure 1B:
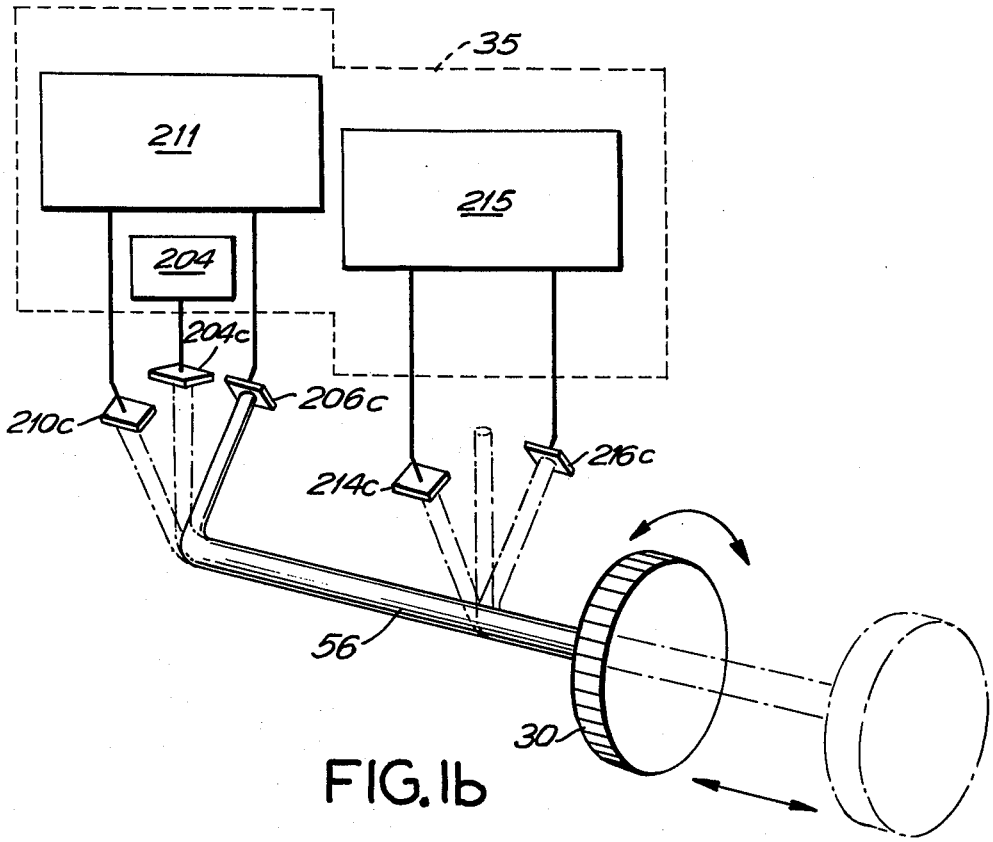
FIG. 1*b* is a block diagram showing the positions of the crown shown in FIG. 1*a;*
Figure 2:
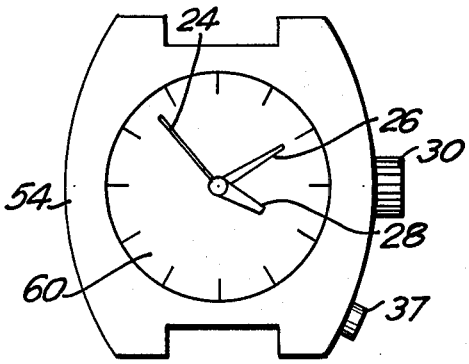
* and FIGS. 2 through 5*c* are plan views of the timepiece of the invention.

In FIG. 1*b*, the crown and shaft are shown in various rotational and axial positions for selecting time zone mode 211, time setting mode 215, normal running mode 204 and shutdown mode. As indicated by the arrows, the crown and shaft can be moved axially and rotated in either the clockwise or counterclockwise directions as required for selecting the desired time mode. When the crown is pushed in, stem 56 engages contact **204*c*, which is inside setting mechanism 32, to put the watch in normal running mode which is controlled by control circuit 35. From the normal running mode, the watch may be put into the time zone made by rotating the crown to allow shaft 56 to engage either contact 206*c* or contact 210*c*. Engaging either contact 206*c* or 210*c* for a predetermined amount of time permits time zone setting to occur in either the clockwise or counterclockwise direction under the control of control circuit 35**.

Pulling crown 30 axially outward takes timepiece 10 out of normal running mode 204 and places it in shutdown mode wherein shaft 56 does not engage any contact. Rotating the crown from this position to permit shaft 56 to engage either contact 214c or contact 216c places the timepiece in the time setting mode. Time correction will occur in either the forward or reverse directions depending upon whether the shaft engages contact 216c or 214c. Control circuit 35 is responsive to and receives signals along line 58 due to shaft movement and engagement with the contacts for providing for and controlling the timepiece second, minute and hour hand positions in order to produce time and secondary function setting changes in either the clockwise or the counterclockwise directions. Crown and shaft movements that similarly provide for timepiece settings are fully described in a copending patent application which has U.S. Ser. No. 397,638 and common assignee herewith.

For timepiece analog display 60, shown in FIGS. 1a and 2 through 5c, to display the current time, time setting circuit 34 is selected and controlled by control circuit 35, in response to movement of crown 30 as described above, to transmit signals on line 421 for the purpose of storing the current time in real time counters 42 (or first counter means). The time stored, in hours, minutes and seconds, in the real time counters is continuously updated by the 1 Hz output signal provided to it by divider network 14 along lines 161 and 411 and displayed in a manner known in the art.

If the alarm is to be set, alarm setting circuit 36 is selected and controlled by control circuit 35, in response to movement of setting member 37, to transmit signals on line 441 for the purpose of setting the digital representation of the time at which the alarm is to be activated in alarm counters 44. Setting member 37 may be a pushbutton. Alarm counters 44 (or second counter means), responsive to the signals provided on line 441, count and store the digital representation of the alarm time based on the movement of the minute and second hands of the timepiece. The novel setting of the alarm time will be discussed more fully below.

Actuation of an alarm signal is controlled by the output signals from comparator 48. The comparator compares the current time provided by real time counters 42 as hours, minutes and seconds on first multiple line 561 with the preset alarm time provided by alarm counters 44 as hours, minutes and seconds on second multiple line 581. Specifically, the representation of "minutes" in alarm counters 44 is divided by five (5) producing a whole number result. For example, if eleven (11) minutes is divided by five (5), the result is two (2). The result of the division is stored in alarm counters 44 and is compared by comparator 48 with the representation of "hours" in real time counter 42. Similarly, the representation of "seconds" in alarm counter 44 directly represents alarm time minutes. The representation of "seconds" stored in alarm counters 44 is compared by comparator 48 with the representation of "minutes" in real time counter 42. To facilitate discussion of the above, the alarm time representations stored in alarm counters 44 will be defined hereafter as "transformed minutes" and "transformed seconds" or collectively as "transformations." When the representation of hours and minutes temporarily stored in real time counters 42 are equal to the transformed minutes and transformed seconds, respectively, of alarm counters 44, as determined by comparator 48, the alarm is activated substantially in a known manner. The output signal provided by comparator 48 on line 501, when the current time, as represented by the analog display, equals the preset alarm time, i.e. when the transformed minutes and seconds equal the real time hours and minutes, causes alarm driver 50 to produce an alarm driving signal of appropriate frequency on line 521 to actuate alarm means 52.

In accordance with the present invention, hand movement counters 46 (or third counter means) count the number of pulses transmitted along line 181 from motor control circuit 16 to driver 18 and motor 20 whenever the timepiece hands are rotated. The pulses are provided to the hand movement counters from line 181 by way of line 461 and are produced each time the minute and second hands, for example, are stepwise rotated for the purpose of setting the alarm time in alarm counters 44 from a known reference position. In this case, the hand movement counters, at least temporarily, contain the digital representation of the "time" indicated by the position of the hands of analog display 60 subsequent to movement from the reference position to the hand position showing the desired alarm time or secondary function setting. This digital representation stored as hours, minutes and seconds in hand counters 46 is provided to comparator 48 on multiple line 481. The digital value stored in hand counters 46 is compared with the digital representation (in hours, minutes and seconds) of real or actual time stored in real time counters 42 after alarm time setting is completed, i.e. when the pushbutton is released. When comparator 48 detects a difference between the digital value stored in hand counters 46, which is now representative of the alarm time setting stored in alarm counters 44, and the real time stored in real time counters 42, a signal is provided by the comparator on line 661 to motor control circuit 16 permitting the motor control circuit, at high speed, to rotate the hands of the timepiece so that they display the real or actual time as indicated by the digital representation of time stored in real time counters 42. In other words, the contents of the real time counters and the hand movement counters will be equivalent, as determined by the comparator, at the moment when the timepiece hands display the real time and high speed hand rotation stops.

The motor control circuit provides signals to driver 18, motor 20 and gear train 22 (control means) in order to rotate the timepiece hands until they display the acutal time as stored in real time counters 42. As long as the comparator detects a difference between the value stored in hand counters 46 and the actual time stored in real time counters 42, the timepiece hands will be made to rotate at high speeds until they are positioned to display the actual time. During the time that a difference exists between the value stored in hand counters 46 and the actual time, a signal will be provided by comparator 48 along line 661 to actuate motor control circuit 16 for the purpose of rotating the timepiece hands until they reach the display positions indicating the actual time in accordance with the contents of real time counters 42.

Since motor 20 can rotate the timepiece hands in either the clockwise or counterclockwise direction, the hands can be made to move the minimal number of steps from the display of alarm time, for example, which has already been set but is now being displayed by timepiece display 60 to the display of actual time in hours, minutes and seconds. In other words, the timepiece hands will take "the shortest route" from their display of alarm time to their display of actual time once the alarm time is set and normal timekeeping operation was resumed. The rotation of the timepiece hands will be in the counterclockwise direction when the difference between the representation of minutes (transformed seconds) in alarm counters 44 and the representation of minutes in real time counters 42 is greater than zero (0) but less than thirty (30) or when the difference is less than negative thirty (−30) as determined and controlled by control circuit 35. Otherwise, the timepiece hands will rotate in the clockwise direction.

As discussed above in terms of crown movement, the timepiece of FIG. 1*a* provides for at least three functions or modes. The shutdown mode in which all counters are reset, and which is otherwise known as the synchronization mode, the alarm setting mode (or time setting mode) and the normal timekeeping operating mode.

In the normal timekeeping operating mode, the actual time is maintained by real time counters 42, and displayed substantially simultaneously on timepiece display 60. However, the real or actual time will be maintained by counters 42, i.e. will not be interrupted, even though the timepiece display is displaying, for example, the alarm time setting.

In the synchronization mode, the timepiece is first shut down by pulling out, in the axial direction, crown 30 as described above. The crown is then rotated for the purpose of positioning the hands to point to the twelve o'clock position. The timepiece hands and counters are now synchronized, at least until battery replacement is required, by resetting the counters to zero. Resetting the counters to zero could be initiated, for example, by depressing pushbutton 37 a predetermined number of times, i.e. 4, while the timepiece is still in the shutdown mode. Subsequent to synchronizing the timepiece hands with the timepiece circuitry, the contents of hand counters 46 will again continuously represent the position of the timepiece hands when either the alarm setting or the real time is displayed on analog display 60. Once the timepiece circuitry and the timepiece hands are synchronized, the previously set alarm time can be displayed by the hands. Alarm time is predeterminedly set and stored in alarm counters 44 as well as initially in hands counters 46. After the alarm time is set, the actual time may again be displayed by the timepiece hands and normal timekeeping resumed. The actual time is stored in real time counters 42.

In the alarm setting mode, following synchronization for example, a predetermined alarm time is set on the timepiece display and a digital representation of the alarm time is stored in alarm counters 44. To enter the alarm setting mode, setting member 37 is depressed and held for a predetermined time, i.e. more than 2 seconds. The timepiece minute and second hands are positioned to point to a reference position of twelve o'clock because of the resetting to zero (0) of the alarm counters and the hands counters. At this point, the "hours" counter in alarm counters 44 contains the equivalent of the "hours" presently maintained in the "hours" counter of real time counters 42. The "minutes" and "seconds" counters in alarm counters 44 are each cleared, i.e. each contain zero. The minute hand can now be rotated to provide for the "hours" representation of the alarm time (transformed minutes) and the second hand can now be rotated to provide for the "minutes" representation of the alarm time (transformed seconds). As described above, the comparator compares the contents of the appropriate predetermined locations in the alarm counters and real time counters in order to activate the alarm at the appropriate time in accordance with the alarm setting. First, turning crown 30 either clockwise or counterclockwise permits rotating the minute hand counterclockwise or clockwise, respectively. The minute hand simply has to be rotated over at least the first five minute span, as measured from the 12 o'clock position on the face of the display, from its current postion, in order to set the alarm time hour to one o'clock. Further, by way of an example, if the minute hand was made to rotate over a ten, eleven, twelve, thirteen or fourteen minute span with respect to the 12 o'clock position, the "hours" counter of the alarm counters would contain the same whole number (integer) two (2) representing an alarm hour of 2 o'clock. The two (2) is obtained by dividing the contents of the "minutes" counter in alarm counters 44 by five (5) as previously discussed. Likewise, if the minute hand were made to rotate over substantially any other span of minutes with respect to the 12 o'clock position, the "hours" counter of the alarm counters would contain only the integer quotient obtained by dividing the contents of the "minutes" counter in alarm counters 44 by five (5). The timepiece provides a tone (one beep) for each movement of the minute hand, i.e. as it moves each display minute during the alarm setting procedure, to indicate that the hours representation stored in alarm counters 44 represents 2 o'clock AM. In like manner, the alarm time of 2 o'clock PM would be indicated by two beeps for each movement of the minute hand during the alarm setting procedure. The "beeps" are controlled by alarm driver 50 based on the 1 Hz signals provided to the alarm driver along line 511 from divider network 14. After the minute hand provides for the "hours" portion of the alarm time, the crown is released. When the crown is turned again in either the clockwise or counterclockwise direction, the second hand is permitted to rotate in the counterclockwise or clockwise direction, respectively. Substantially as in the manner of positioning the minute hand to represent the alarm hour, the second hand is rotated such that each one second movement of the second hand represents an alarm time of one minute. In other words, the "seconds" counter of the alarm counters counts one minute every time the second hand is rotated over a one second span (a count of one minute per each span of one second) as would be visually indicated to the user on the face of display 60. As an example, if the second hand was made to rotate over a twenty second span, the "minutes" counter of the alarm counters would contain the number twenty (20) which represents twenty minutes. Considering both prior examples together, the alarm time would be stored in alarm counters 44 as 2:20 and if one beep was provided, as explained above, the alarm time would be stored as 2:20 AM. Therefore, when comparator 48 detects that the contents of constantly updating real time counters 42 is equivalent to the preset contents of alarm counters 44, an alarm will sound in a manner known in the art and which was described above.

Once the alarm time is set, the timepiece hands can again display the actual time by depressing setting number 37. The hands will rotate, as discussed above, over the shortest possible distance, either clockwise or counterclockwise, from the indication of the alarm time, described above, to the indication of the actual time, the representation of which is contained in real time counters 42. The hands rotate from the alarm time setting position to the actual time position when the comparator detects that the "time" represented in hand counters 46 differs from the actual time maintained in real time counters 42. Until the contents of the hand counters and real time counters are equal, the comparator provides a signal on line 661 to motor control circuit 16 for the purpose of rotating the timepiece hands at high speed. When the contents of the counters are determined by the comparator to be equivalent, hand rotation stops. The hands on display 60 now indicate the actual time as contained in the real time counters. The timepiece hands move rapidly over the shortest possible distance from the display of alarm time setting to the display of actual time when the setting member is depressed while a difference is detected in the comparator between the contents of hand counters 46 and real time counters 42. Depressing the setting member will also terminate the alarm sound once it is activated.

The alarm time or the present contents of alarm counters 44 can be displayed while the timepiece is in the normal operating mode, i.e. when the hands indicate the actual time. In this case, setting member 37 is depressed for less than a predetermined period of time, i.e. less than 2 seconds. Automatically and quickly, the minute and second hands move to their respective positions to display the alarm time which is preset as described above. The hands can be made to automatically rotate from the actual or real time position to the alarm time setting position when the comparator detects the "time" represented in hand counters 46 differs from the alarm time maintained in alarm counters 44. The timepiece hands rotate quickly for the reasons provided above until the alarm time is displayed, i.e., when the contents of hand counters 46 and alarm counters 44 are substantially equivalent. A tone (at least one beep) is provided by alarm driver 50 in accordance with signals received on line 511 from divider network 14 if the alarm is set for AM or PM. No tone is provided if the alarm is not set for a particular alarm time. If the alarm is not set (not on), depressing the setting member for a short predetermined time, i.e. less than 2 seconds, will set the alarm. Thereafter, the alarm will sound when the actual time equals whatever time is currently stored in alarm counters as detected by the comparator. If the alarm is set (on), the setting member is depressed for a short predetermined time, i.e. less than 2 seconds, in order to clear or turn off the alarm condition. After a delay of a few seconds subsequent to the display of the alarm time, the hands automatically rotate from the display of the alarm time to the display of the actual time permitting normal timekeeping display and operation to continue. The actual time is always maintained and updated in real time counters 42 without interruption so that normal time keeping operation never really ceases unless the battery needs to be replaced. Only the display of the actual time is interrupted when setting or displaying the alarm time or when synchronizing the display with the timepiece circuitry on startup, i.e. after the battery is replaced.

Figure 1C:
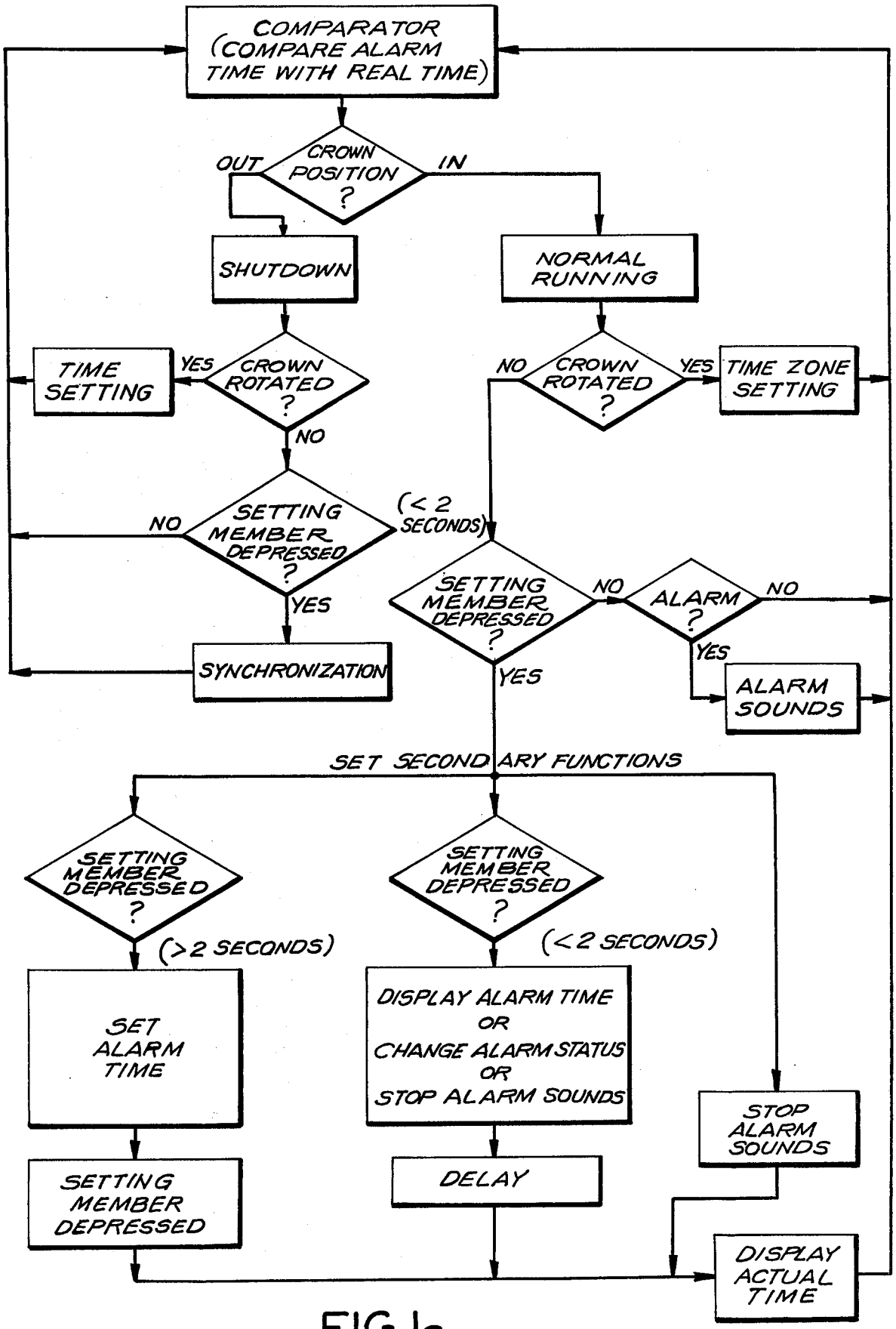

The overall sequential operation of timepiece 10 is shown in the flow chart of FIG. 1*c*. The operation of timepiece 10 has been described above but the description can be more easily understood by referring to the flow chart. One skilled in the art should easily understand the operation of timepiece 10 by reference to the flow chart of FIG. 1*c*.

Figure 3A:
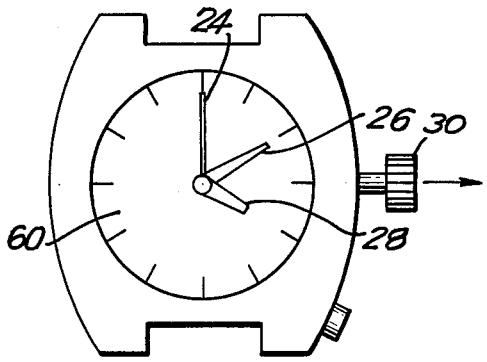
Figure 3B:
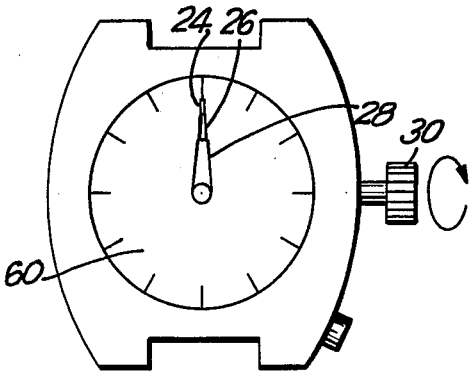
Figure 3C:
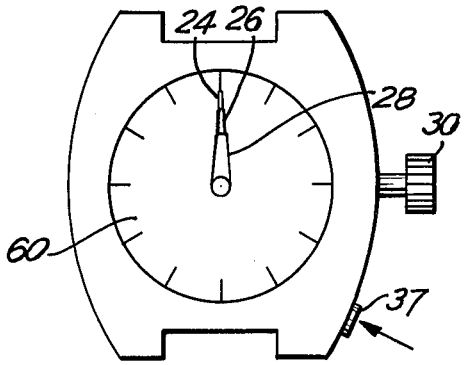

FIGS. 3*a* thru 3*c* show the steps involved in synchronizing the timepiece hands with the timepiece circuitry so as to provide for a correlation between the position of the hands and the contents of hand counters 46. In FIG. 3*a*, crown 30 is pulled out in the axial direction. This puts the timepiece in the shutdown mode and permits second hand 24 to rotate to the twelve o'clock position. In FIG. 3*b*, while the timepiece is still in the shutdown mode, crown 30 is rotated for the purpose of positioning the minute and second hands to the twelve o'clock position. In FIG. 3*c*, setting member 37 is depressed four times thereby setting all timepiece counters. The timepiece counters are now synchronized with the position of the hands on display 60.

Figure 4A:
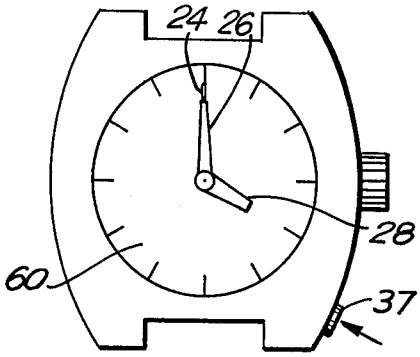
Figure 4B:
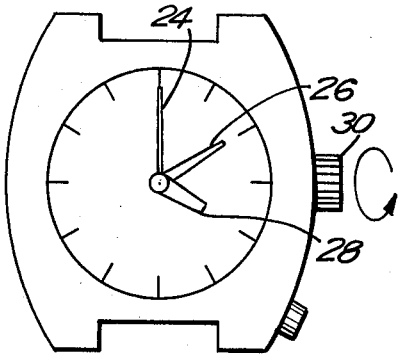
Figure 4C:
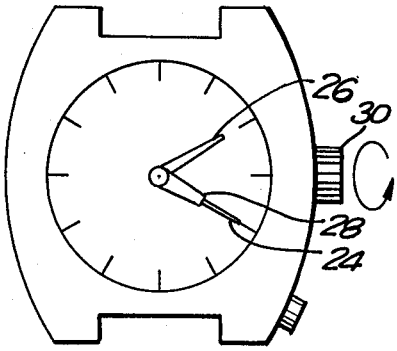

FIGS. 4*a* thru 4*c* show the steps involved in setting the alarm using predetermined timepiece hands. In this case, the minute hand is used to set the alarm hour and the second hand is used to set the alarm minute. In FIG. 4*a*, setting member 37 is depressed for more than two seconds permitting the minute and second hands to rotate to the twelve o'clock position automatically. In FIG. 4*b*, the crown is rotated either clockwise or counterclockwise to turn the minute hand which is used to set the alarm hour. If the minute hand is moved, for example, a total of ten (eleven, twelve, thirteen or fourteen) minutes as indicated on the face of the display, the contents of alarm counters representing the alarm time in hours becomes two (2). The timepiece will produce a tone (one beep) if the alarm time is AM or two tones (two beeps) if the alarm time is PM. As an example, if the minute hand is rotated, for the first time, to point to the one o'clock position of the display, the time, in hours, stored in alarm counters is one (1:00 ) AM. One beep will be heard. However, if the minute hand is made to rotate until it reaches the one o'clock position for the second time, the time, in hours, stored in alarm counters is one (1:00) PM or 1300 hours based on the twenty-four hour clock. Two tones or beeps would be heard when setting the alarm hour to 1:00 PM. After setting the alarm hour, the crown is released. When the crown is rotated again, the second hand rotates to the desired position for the purpose of indicating alarm minutes as shown in FIG. 4*c*. If the second hand was made to rotate twenty seconds so that it pointed to four o'clock, the alarm minutes would be set at twenty minutes. Based on this example, when the crown is released, the alarm counters will contain the alarm time of 2:20. The alarm time could be either AM or PM as explained above. The timepiece alarm will be activated when the contents of the seconds portion of alarm counters 44 equals the contents of the minutes portion of real time counters 42 and when the contents of the minutes portion of the alarm counters (divided by five as explained above) equals the contents of the hours portion of the real time counters as detected substantially simultaneously in comparator 48. The setting member is then depressed to permit the hands of the display to rotate to positions indicating the actual, current time which is located in the real time counters and which has been continuously updated to maintain the correct time during the alarm setting mode.

Figure 5A:
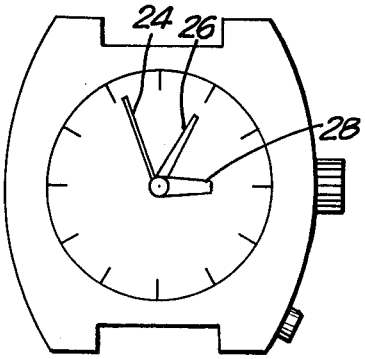
Figure 5B:
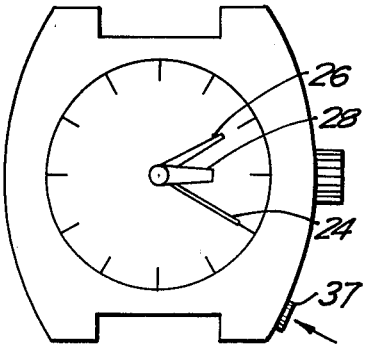
Figure 5C:
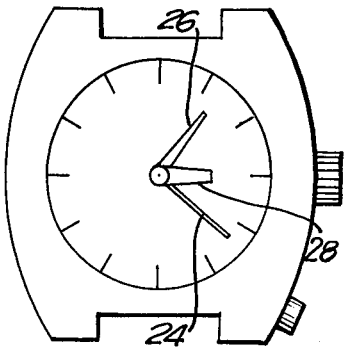

FIGS. 5*a* thru 5*c* show the steps required to display the preset alarm time when the timepiece is in the normal operating mode. FIG. 5*a* shows the current time of 3:05. By depressing setting member 37 for less than 2 seconds, the minute and second hands automatically rotate quickly to display the alarm time as shown in FIG. 5*b*. The alarm time example provided in FIG. 4*c* is used as the example in FIG. 5*b*. A tone indicates that the alarm has been set. Otherwise, no tone indicates that the alarm was not set even though the contents of the alarm counters have been displayed. The setting member is depressed for less than 2 seconds in order to set the alarm if it has not already been set or, if desired, to turn off the alarm if it has already been set. After a few seconds have elapsed subsequent to the display of the alarm time, the hands will rotate quickly over the "shortest possible route" as described above to the appropriate positions as shown in FIG. 5*c* representing the actual time which has been maintained and updated in real time counters 42. Normal timekeeping operation and display is then resumed.

The operation of timepiece 10 is further described in above mentioned copending patent application having U.S. Ser. No. 397,638.

Based on the above description of the operation of timepiece 10, another secondary timepiece function that can be implemented by timepiece 10 includes heart rate determination. For example, the heart rate measurement mode could be selected from the normal running mode. Once the heart rate was selected, the hour and minute hands would rotate, automatically, to the twelve o'clock positions until a selected counter counted two pulses representing heart beats. Using this heart beat information, the hour and minute hands could be positioned to display heart rate (a secondary function) just as, in the above embodiment, the hands were used to display alarm time or updated real time. This concept is more properly the subject matter for a separate patent application.

What is claimed is:

1. An electronic analog timepiece having at least one secondary function means for providing at least one timepiece secondary function, a motor control circuit for providing output signals, timepiece display members including second, minute, and hour hands, a control means for selectively displacing and positioning said display members in response to said output signals to alternately represent an uninterrupted and continuously updated present time and a secondary function setting representative of the time of occurrence of said secondary function, comparator means, first counting means for storing the representation of said uninterrupted and continuously updated present time and second counting means for storing the representation of said secondary function setting set by said control means, characterized in that:

said timepiece includes third counting means responsive to said output signals from said motor control circuit for counting and storing the number of pulses produced therefrom representing the movement and position of the minute hand and second hand after being replaced from a reference position to either a position representing the secondary function setting or a position representing present time and in which said secondary function setting represented in hours and minutes is stored in said second counting means in response to movement and position of said minute hand and second hand from a reference position; said comparator means comparing the content of said third counting means with the content of either said first or second counting means for actuating said motor control circuit when said compared contents are unequal to provide signals to said control means for displaying and positioning by the shortest route and at an accelerated rate said display members from representing either said secondary function setting to said present time or from representing said present time to said secondary function setting.

2. An electronic analog timepiece having at least one secondary function means for providing at least one timepiece secondary function, a motor control circuit for providing output signals, timepiece display members including second, minute and hour hands, a control means for selectively displacing and positioning said display members in response to said output signals to alternately represent an uninterrupted and continuously updated present time and a secondary function time representative of the time of occurrence of said secondary function, and first counting means for storing the representation of said uninterrupted and continuously updated present time set by said control means, said timepiece comprising:

(a) second counting means for storing the representation of said secondary function time set by said control means, said secondary function time represented in hours and minutes by predeterminedly positioning said minute hand and said second hand from a known reference position;

(b) third counting means responsive to said output signals from said motor control circuit for storing a value indicative of the position of said display members after being displaced from a reference position to alternately represent present time and secondary function time; and (c) comparator means for comparing the content of said second storing means with the content of said first storing means for actuating said secondary function means when said content of said first storing means is substantially equal to the content of said second storing means; for comparing the content of said third storing means with the content of said first storing means for actuating said motor control circuit when said compared contents are unequal to displace and position by the shortest route and at an accelerated rate said display members from representing secondary function time to present time without preventing the content of said first storing means from being updated and without changing the content of said second storing means; and, for comparing the content of said third storing means with the content of said second storing means for actuating said motor control circuit when said compared contents are unequal to displace and position by the shortest route and at an accelerated rate said display members from representing present time to secondary function time without preventing the content of said first storing means from being updated and without changing the content of said second storing means.

3. The analog timepiece of claim 2 in which said secondary function time in hours and minutes is provided by transforming the representations of said minute hand and said second hand respectively in said second storing means.

4. The analog timepiece of claim 3 in which said transformation of said representation of said minute hand in said second storing means is produced by dividing said representation by the integer five.

5. The analog timepiece of claim 2 in which said time of occurrence of said secondary function is set by rotating said hands in either the clockwise or counterclockwise direction.

6. The analog timepiece of claims 1 or 2 in which the reference position is the 12 o'clock position.

* * * * *